United States Patent [19]

Saggers

[11] Patent Number: 4,877,378

[45] Date of Patent: Oct. 31, 1989

[54] VIBRATORY DIAPHRAGM PUMPS

[76] Inventor: Michael J. Saggers, 9 Pennycroft, Harpenden, Hertfordshire, AL52PD, England

[21] Appl. No.: 95,171

[22] PCT Filed: Dec. 11, 1986

[86] PCT No.: PCT/GB86/00759

§ 371 Date: Aug. 10, 1987

§ 102(e) Date: Aug. 10, 1987

[87] PCT Pub. No.: WO87/03650

PCT Pub. Date: Jun. 18, 1987

[30] Foreign Application Priority Data

Dec. 11, 1985 [GB] United Kingdom ..... 8530514
Dec. 12, 1985 [GB] United Kingdom ..... 8530666
Dec. 12, 1985 [GB] United Kingdom ..... 8530667

[51] Int. Cl.[4] ..... F04B 45/04; F04B 35/04
[52] U.S. Cl. ..... 417/299; 417/413
[58] Field of Search ..... 417/412, 413, 415, 299, 417/361, 419

[56] References Cited

U.S. PATENT DOCUMENTS

| | | | |
|---|---|---|---|
| 2,109,718 | 3/1938 | Bayers | 417/413 |
| 2,471,796 | 5/1949 | Thiberg | 417/413 |
| 2,764,947 | 10/1956 | Germann | 417/413 |
| 2,788,170 | 4/1957 | Kato et al. | 417/413 |
| 3,055,555 | 9/1962 | Reiter | 417/413 |
| 3,606,588 | 9/1971 | Romerhaus | 417/299 X |
| 3,671,151 | 6/1972 | Duke et al. | 417/413 X |
| 3,838,944 | 10/1974 | Kolfertz | 417/312 |
| 3,967,644 | 7/1976 | St. Laurent | 417/299 X |
| 4,044,745 | 8/1977 | Brinkman et al. | 417/415 X |
| 4,154,559 | 5/1979 | Enomoto | 417/413 |
| 4,162,876 | 7/1979 | Kolfertz | 417/413 |
| 4,264,282 | 4/1981 | Crago | 417/363 X |
| 4,321,940 | 3/1982 | Krechel et al. | 417/299 X |
| 4,470,428 | 9/1984 | Bishop et al. | 417/299 X |

FOREIGN PATENT DOCUMENTS

| | | | |
|---|---|---|---|
| 55-153877 | 12/1980 | Japan | 417/413 |

*Primary Examiner*—Carlton R. Croyle
*Assistant Examiner*—Leonard P. Walnoha
*Attorney, Agent, or Firm*—Thomas & Kennedy

[57] ABSTRACT

A pneumatic vibratory diaphragm pump, having a casing (12, 14) comprising an upper chamber (17) having an inlet (59) by which air can be drawn from outside the casing and a lower chamber (16) having an outlet (N) from which air can issue from the casing, an oscillatory armature (22) within the lower chamber to actuate a diaphragm (**28*b*) of at least one diaphragm and valve assembly (28, 30) and drive (80,20) to cause oscillatory movement of the armature. Each diaphragm and valve assembly is arranged so as to induce air to be pumped by it from the upper chamber and to discharge air into the lower chamber whereafter the discharged air is issued from said outlet. Venting means (70, 74, 76**) is provided to allow air which has been discharged from the casing into a container to return therefrom and exhaust from the casing when the pump is inactive.

10 Claims, 8 Drawing Sheets

FIG. 15.
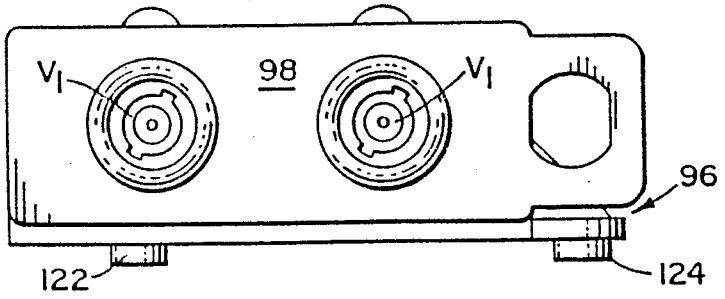
FIG. 16.
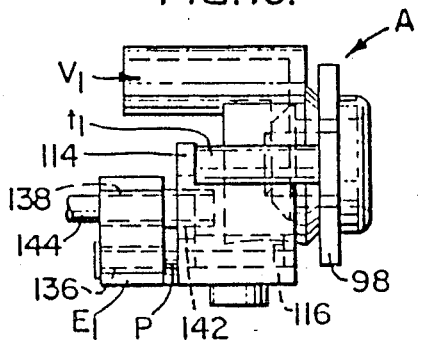
FIG. 17.
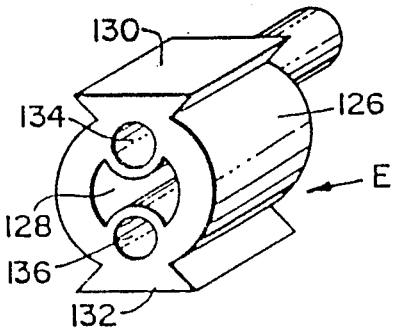
FIG. 18.
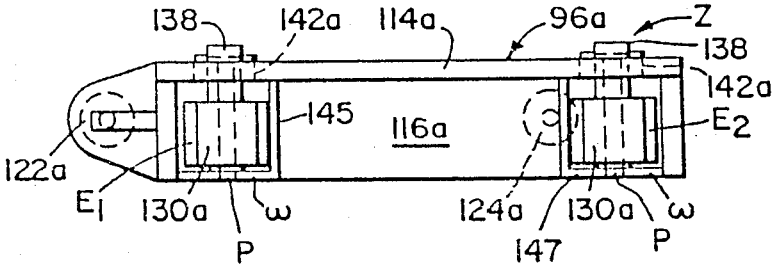
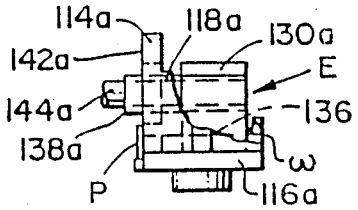
FIG. 19.

VIBRATORY DIAPHRAGM PUMPS

This invention relates to a vibratory diaphragm pump which is particularly, but not exclusively, suitable for intermittent operation for example in a fluidic system for intermittent compression therapy.

In such application the pump supplies pressurized fluid, normally air, to one or more inflatable garments when the pump is activated and allows air to evacuate from the or each garment through the pump casing when the pump is deactivated in a cylic operation. The garments typically comprise a sealed double-skinned sleeve which more usually is worn about a patient's limb to be treated and which cylically is inflated and deflated so as to apply to that limb an intermittent compressive force.

However, in a more general application the pump may be utilized to evacuate a fluid from or supply fluid under pressure to a suitable container.

One aspect of the invention provides a pneumatic vibratory diaphragm pump having a casing accommodating at one of its ends a driving coil to drive an oscillatory armature and diaphragm assembly within the casing having at least one diaphragm the arrangement being such that air pumped by each diaphragm issues into the enclosure defined by the casing prior to being transferred therefrom whereby the enclosure itself provides an expansion chamber for the pump.

Another aspect of the invention provides a pneumatic vibratory diaphragm pump, having a casing comprising an upper chamber having an inlet by which air can be drawn from outside the casing and a lower chamber having an outlet from which air can issue from the casing, an oscillatory armature within the lower chamber to actuate a diaphragm of at least one diaphragm and valve assembly and drive means to cause oscillatory movement of the armature wherein each diaphragm and valve assembly is arranged so as to induce air to be pumped thereby from the upper chamber and to discharge air into the lower chamber from whence the discharged air issues from said outlet.

According to a feature of this aspect of the invention the upper and lower chambers are separated by a partition which isolates said chambers from one another during operation of the pump and wherein an inlet for each diaphragm and valve assembly accommodated in the lower chamber communicates with said upper chamber.

According to another feature of this aspect of the invention, the lower chamber is provided by a lower shell of the casing and the upper chamber is provided by an upper shell of the casing, said upper and lower shells being secured together in superposed fluid-tight relationship.

According to yet another feature of this aspect of the invention, the upper chamber also accommodates an oscillatory armature to actuate a diaphragm of at least one further diaphragm and valve assembly and drive means to cause oscillatory movement of the armature in the upper chamber, each diaphragm and valve assembly within said casing being arranged so as to induce air to be pumped thereby from the upper chamber and to discharge air into the lower chamber from whence the discharged air issues from said outlet. In some constructions where this feature is adopted, the armature in the upper chamber may extend in the opposite direction to that of the armature in the lower chamber and the drive means for each armature is disposed at opposed ends of the casing in the respective chambers.

According to a feature of either of the aspects of the invention, venting means may be provided to allow air which has been discharged from the casing into a container to return therefrom and exhaust from the casing when the pump is inactive said venting means being arranged to close the exhaust passage when the pump is operative. Preferably, operation of the venting means to open and close the exhaust passage is automatic upon respectively deactivating and activating the pump.

Another aspect of the invention provides a vibratory diaphragm pump comprising a casing formed by a pair of superposed shells which define between them a pump chamber and wherein each shell accommodates an oscillatory armature to actuate a diaphragm of at least one diaphragm and valve assembly within that shell and drive means within that shell to cause oscillatory movement of said armature. Preferably, the armature in one shell extends in the opposite direction to that of the armature in the other shell and the drive means for each armature is disposed at opposed ends of the casing in their respective shells.

Yet another aspect of the invention provides a vibratory diaphragm pump comprising a casing which accommodates at least one armature to actuate a diaphragm of at least one diaphragm and valve assembly and drive means to cause oscillatory movement of each diaphragm, inlet means through which air to be pumped can be induced into the casing and outlet means through which pumped air can be discharged from the casing and wherein venting means is provided automatically to allow air which has been discharged from the casing into a container to return therefrom and exhaust from the casing when the pump is deactivated. Preferably, said venting means comprises a valve controlled outlet from the casing independent of said outlet means.

According to a feature of any of the aspects of the invention, said drive means is coupled to control means for causing intermittent operation of the pump.

Yet another aspect of the invention provides an armature for a vibratory diaphragm pump which armature comprises a main body portion carrying at one end thereof a pair of opposite polality magnets, the main body portion having a pivotal element by which the armature can be pivotally connected to a pair of diaphragm assemblies, adjacent opposed sides of the body portion, and a resilient element interconnecting the main body portion with an end part of the armature by which end part the armature can be mounted for vibratory movement of the body part relative to the end part. for a vibratory diaphragm pump which armature comprises a main body portion carrying at one end thereof a pair of opposite polarity magnets, a spring steel plate having one of its ends secured to the opposite end of the main body portion and its opposite end secured to an end part of the armature by which end part of the armature can be mounted for vibratory movement of the body part relative to the end part.

Yet another aspect of the invention provides an armature for a vibratory diaphragm pump which armature comprises a main body portion carrying at one end thereof of a pair of opposite polarity magnets, said body portion including a resiliently pivotal element having means for attachment to a pair of diaphragm assemblies, one located adjacent each of the opposed sides of said body portion, and including a flexible portion adapted to be secured to a fixed support so that the armature can be caused to vibrate relative to the fixed support.

Yet another aspect of the invention provides a mounting assembly for supporting a pump casing so that the static load of the casing is held resiliently in spaced relationship relative to a support platform and so that the transmission of dynamic forces between the casing and the support platform is minimized, said assembly comprising a mounting element fixed to the support platform at each of two opposed ends of said casing, a resilient element interposed between said casing and each mounting element by which the static load of the casing is held in spaced relationship relative to the support platform, each of said resilient elements being connected to the casing and to respective ones of the mounting elements and wherein the connection between the resilient element and the support element allows for limited universe movement of the pump casing relative to the support elements.

Two pumps embodying the invention will now be described by way of example, with reference to the accompanying drawings in which:

FIG. 15 is an end view of the assembly shown in FIG. 14;

FIG. 16 is a side view of the assembly shown in FIG. 14;

FIG. 17 is a perspective view of one of the resilient elements incorporated in the mountings;

FIG. 18 is a plan view of the shock absorbing mounting assembly shown at the left-hand end and right-hand ends of the pump casing shown in FIG. 1 and the left hand end of the pump casing shown in FIG. 11; and FIG. 19 is a side view, partly broken away, of the assembly shown in FIG. 18.

Figure 1:
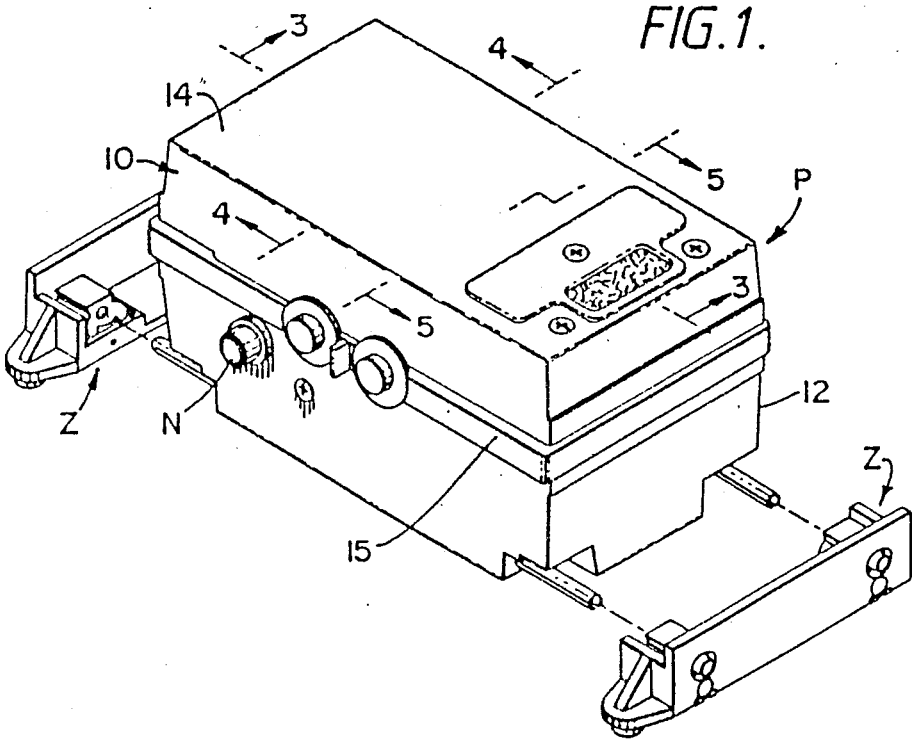
FIG. 1 is a perspective view of one pump in which the operative parts of the pump are housed in the lower shell of the casing of the pump.
Figure 10:
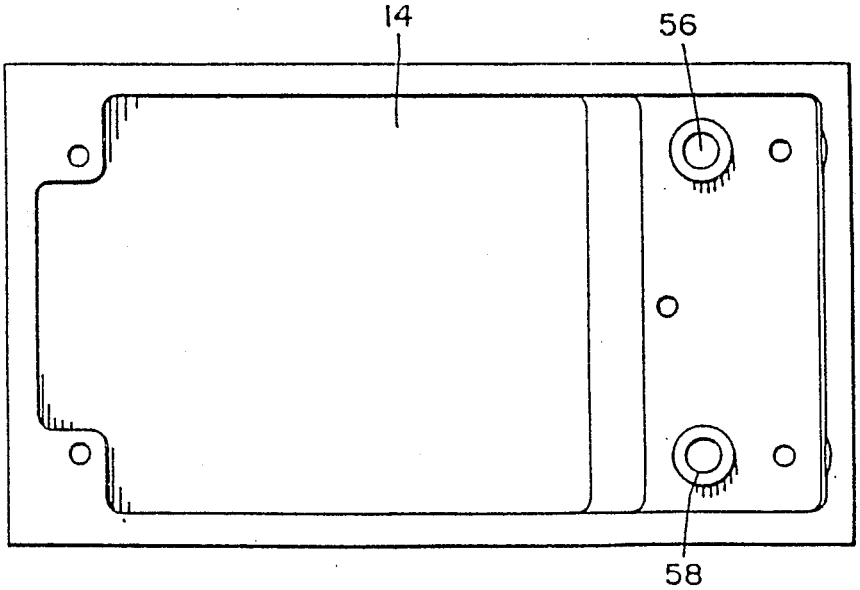
FIG. 10 is an under plan view of the upper shell of the pump shown in FIG. 1.
Figure 2:
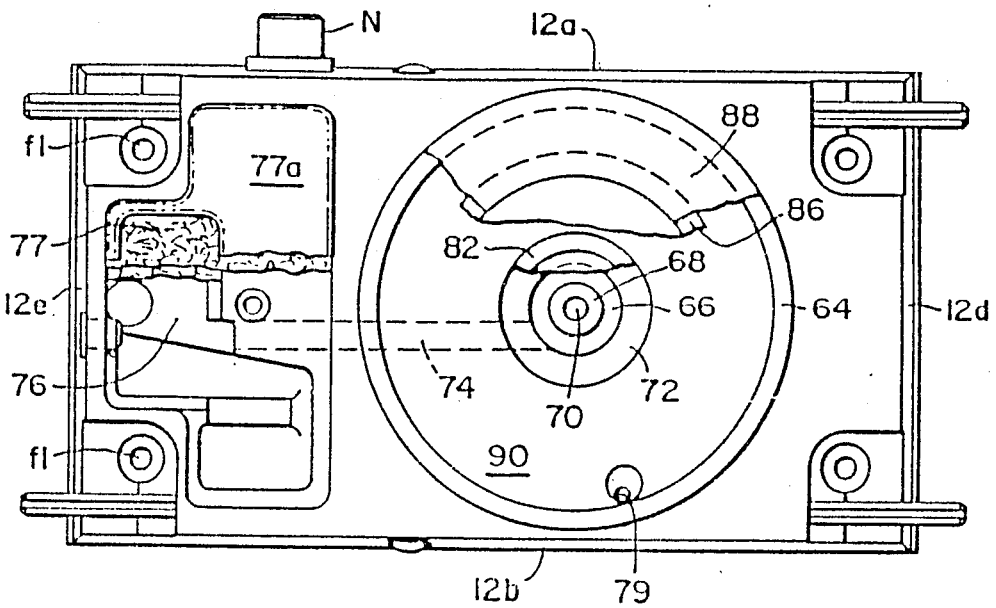
FIG. 2 is a plan view partly cut away of the underside of the lower shell of the pump of FIG. 1.

Referring first to FIGS. 1–6, a vibratory diaphragm pump 'P' comprises a casing 10 which is a cast aluminium structure having an open-top elongate lower shell 12 and an upper shell 14 which is fitted to the lower shell so as to provide a lid. A partition 15 is interposed between the upper end lower shells so as to create an outlet chamber 16 in the lower shell and an inlet chamber 17 in the upper shell. The partition and its relationship to chamber 16 and 17 will be described in more detail below.

The lower shell includes sidewalls 12*a*, 12*b*; endwalls 12*c*, 12*d* and a base 12*e*. One end of the lower shell receives a laminated ferrous E-stack 18 whose central limb 18*a* carries a driving coil 20. The E-stack stands on raised plinths 19, 19*a* formed in opposed corners of the lower shell adjacent endwall 12*d*.

An armature assembly, generally designated by reference numeral 22 extends longitudinally of the lower shell and centrally thereof immediately above a rib structure formed in the base and comprising longitudinal rib 21 and transverse rib 21*a*. The armature 22 has one of its ends secured in a downwards tapered socket 24 provided internally of the lower shell integrally formed with end wall 12*c*.

The opposite end of the armature terminates in a flanged head 26 adjacent the E-stack 18. The flanged head incorporates a pair of spaced magnets 26*a* and 26*b* of opposite polarity which are seated in side-by-side relationship on a common keep plate in close proximity to the E-stack limbs. The flanged head 26 is integral with a main body portion 34 of the armature which is connected to an end part 36 by means of a flat metallic leaf spring 38. Thus, the armature resiliently is mounted with respect to the lower shell and is caused to oscillate about its fixed end part 36 across the exposed ends of the E-stack limbs when electrical current is passed through coil 20.

Diaphragm valve assemblies 28 and 30 are disposed one on each side of the main body portion of the armature and each assembly comprises a valve body 28*a*, 30*a* and a flexible cup-shaped diaphragm 28*b*, 30*b* respectively, described in more detail later. Both diaphragms of the diaphragm valve assemblies 28 and 30 are connected to the armature 22 by a resilient linkage 40. For this purpose, the main body portion 34 of the armature is formed with a square cross-sectional transverse through bore 42 in which a resiliently pivotal linkage block 44 is received with clearance. Block 44 resiliently is mounted within bore 42 by a fixed pin 46 which extends through a vertical bore formed in the block 44 and whose axis is perpendicular to the axis of through bore 42 and a resilient material 50 which surrounds the fixed pin 46. A pair of linkage arms 52 and 54 respectively extend outwardly from opposed faces of the linkage block 44. The arms terminate in flat cross-heads by which the linkage is connected internally of the operative faces of the diaphragms 28*b* and 30*b*, respectively. Thus, the linkage block 44 can pivot resiliently within bore 42 about fixed pin 46 as the armature body oscillates.

The resilient linkage allows the diaphragms to be flexed evenly and squarely with respect to the notional longitudinal axis of the lower shell 12 notwithstanding the arcuate path described by the oscillatory movement of the armature. Such a construction greatly reduces the stresses to which the diaphragms might otherwise by subjected, increases longivity of the diaphragms and, of course, increases the volume of air pumped thereby and hence the performance of the pump.

Since the armature spring 38 comprises a straight metal strip which is anchored in end part 36, it is able to deflect by substantially the same amount either side of its rest position without bias in either direction, thereby operating the opposed diaphragms equally.

The armature body and end part preferably is moulded from a plastics material, the spring 38 having its opposite ends embedded in the end part 36 and main body part 34, respectively, during the moulding process. Likewise the magnets **26*a* and 26*b* together with their common keep plate also are incorporated into the armature head 26** at the time of moulding.

The end part 36 is formed as a downwardly tapered peg which mates with the tapered socket 24. Therefore, the armature and diaphragm valve assemblies can be preassembled whereafter that assembly can be mounted in position by driving the tapered peg end part 36 into its mating socket 24.

The diaphragms are formed from an elastomeric material such as rubber or a rubber compound or neoprene into a dished element having an internal diaphragm cavity.

In operation, when the operative face of a diaphragm **28*b* or 30*b* is flexed by the armature 22 outwardly, i.e. away from the valve body 28*a* or 30*a* an inlet flap valve lifts and air is drawn into the diaphragm cavity via an inlet nozzle 28*c* or 30*c*. When the operative face of a diaphragm is next flexed by the armature inwardly i.e. towards the valve body, the inlet flap valve seats and an outlet valve lifts and the air previously induced into the diaphragm cavity is expelled through an outlet orifice 28*c*' and 30*c*'**. Of course, this represents one cycle of operation of one of the diaphragm valve assemblies and is well known per se.

Figure 4:
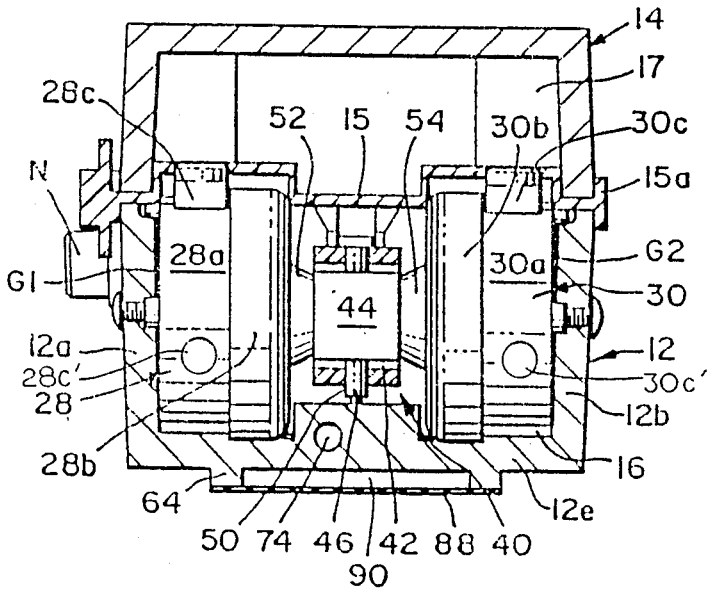
FIG. 4 is an end sectional view of the pump shown in FIG. 1 taken along the line 4—4.

As shown in FIG. 4, the diaphragm valve assemblies 28 and 30 are mounted within the lower shell in opposed relationship one on each side of the armature. Diaphragm valve assembly 28 is secured to sidewall **12*a* by a fixing screw which locates in a fixing boss of the valve body, the open ends of the inlet and outlet cavities of the valve body being sealed by a gasket 'G1'. Diaphragm valve assembly 30 similarly is secured to sidewall 12*b* with the imposition of gasket 'G2'. Both diaphragm valve assemblies are located with inlet nozzles 28*c* and 30*c* respectively upstanding uppermost of the lower shell and outlet orifices 28*c*' and 30*c*'** opening into the lower chamber.

Figure 3:
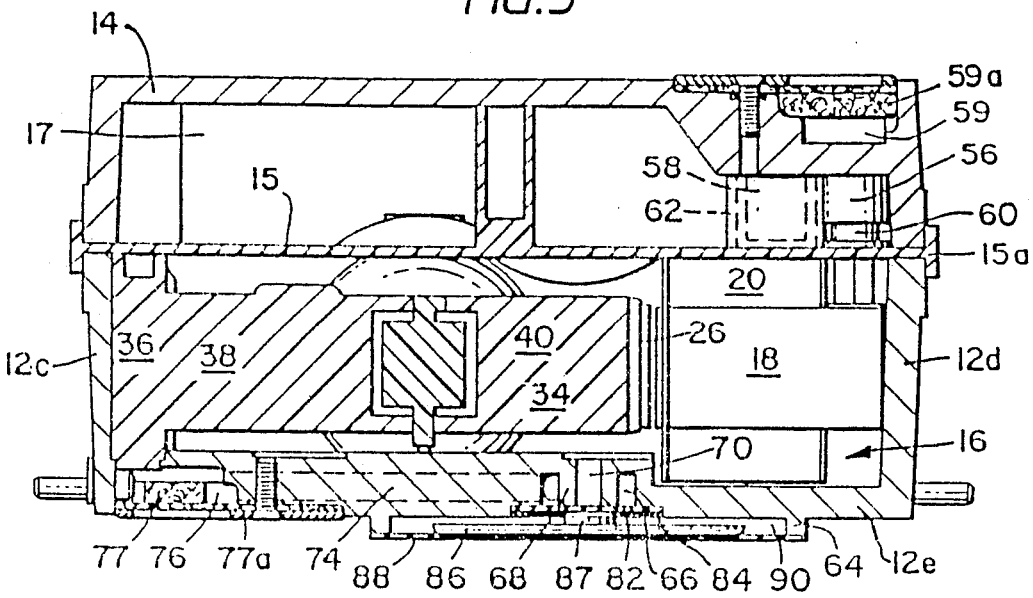
FIG. 3 is a side sectional view of the pump shown in FIG. 1 taken along the line 3—3.
Figure 5:
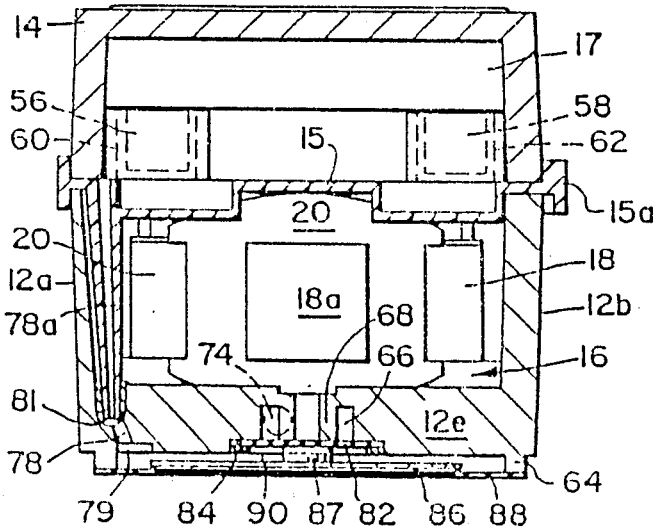
FIG. 5 is an end sectional view of the pump shown in FIG. 1 taken along the line 5—5.
Figure 6:
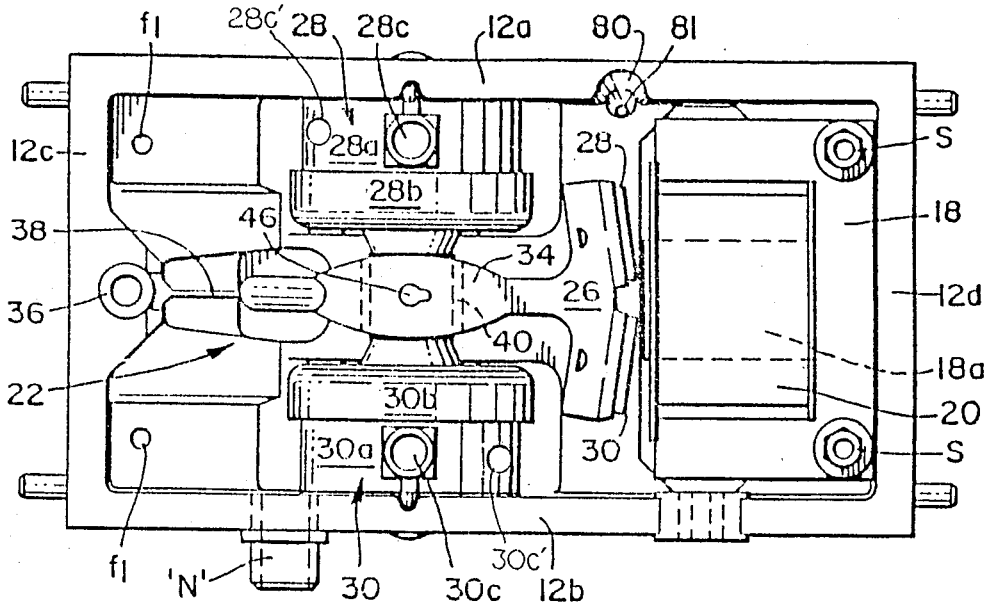
FIG. 6 is a plan view of the lower shell of the pump casing of FIG. 1 with the internal components of the shell present.
Figure 7:
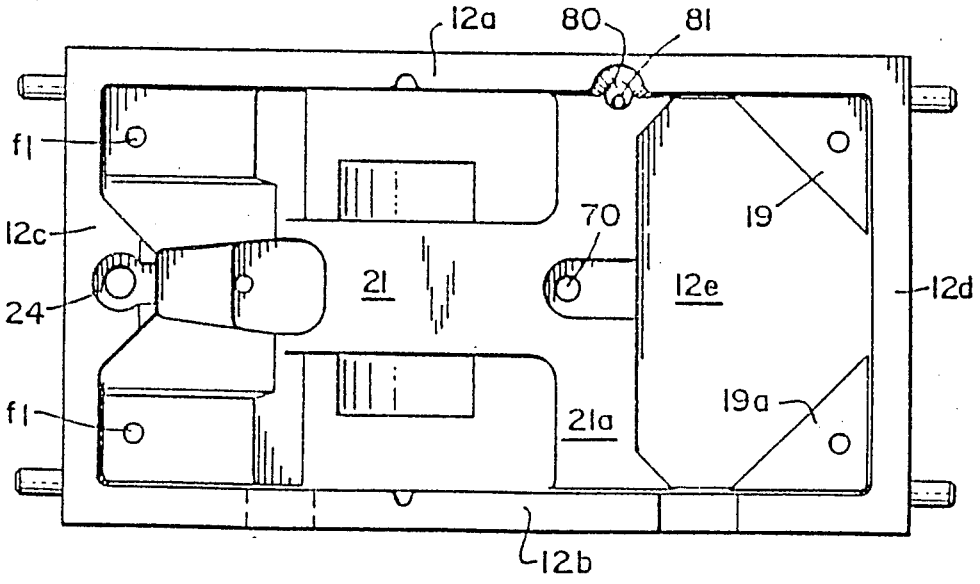
FIG. 7 is a plan view of the lower shell of the pump casing of FIG. 1 with the internal components of the shell omitted.
Figure 8:
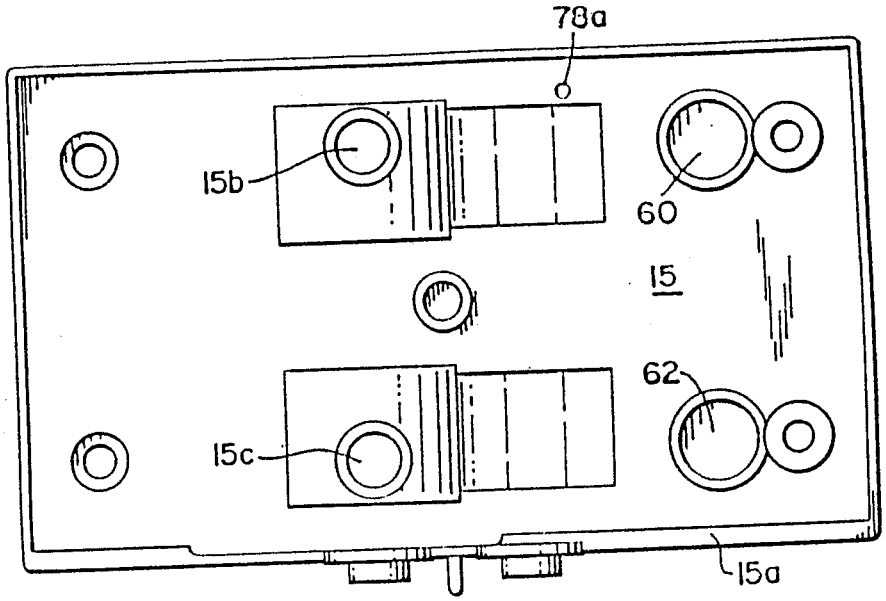
FIG. 8 is a top plan view of a partition which separates the two shells and thereby the inlet and outlet chambers of the pump shown in FIG. 1.
Figure 9:
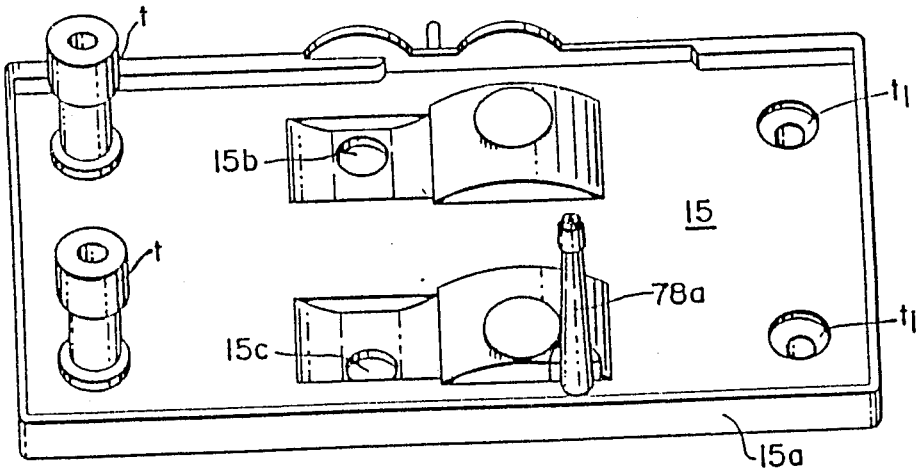
FIG. 9 is an underplan view of the partition shown in FIG. 8.

Referring again to FIGS. 8,9 and to FIGS. 3, 4 and 5, partition 15 which is formed from a plastics material closes the open top of the lower shell and isolates the upper chamber 17 from the lower chamber 16 and also seals the casing so that at least lower chamber 16 is fluid-tight. For this latter purpose, the partition has a peripheral flange **15*a*** which seals around the interface joint between the upper and lower shells.

The partition includes a pair of spaced apertures **15*b*, 15*c* which are in registry with and seal around the inlet nozzles 28*c* and 30*c* of diaphragm valve assemblies 28 and 30 whereby the diaphragm valve assemblies are in communication with the upper chamber 17 of the casing. The upper shell is formed with a pair of inlet tubes 56, 58 through which air is drawn into the upper chamber from outside the casing via a filter cavity 59. The filter cavity is provided with a suitable filter 59*a* through which induced air passes prior to entering the chamber via the inlet tubes. In order to reduce noise the induced air passes through a labyrinth provided by locating the free ends of the inlet tubes 56,58 in blind sockets 60, 62** respectively upstanding from the top surface of the partition and which are of larger diameter than the inlet tubes.

In operation of the pump the diaphragms are flexed alternatively and air is drawn into the upper chamber via the filter cavity, the inlet tubes, the inlet labyrinth sockets and thence through the inlet nozzles of the diaphragm valve assemblies whereafter the induced air charge of each diaphragm valve assembly is discharged through its outlet orifice into the lower chamber 16 of the casing. Sidewall 12b of the lower casing is provided with an outlet nozzle 'N' adjacent endwall **12*c* through which discharged air is expelled from the casing. In applications where the pump is employed for inflating a garment of the kind used in intermittent compression therapy, the pump is activated intermittently and the outlet nozzle normally is connected to a pressure control device, through which air expelled from the pump is passed before issuing into a garment. Thus, most frequently the lower chamber 16** is under pressure of a variable amount up to e.g. 200 mm Hg above atmospheric pressure.

In order to allow an inflated garment to deflate during the period when the pump is deactivated during intermittent operation it is necessary to provide a return passage for the air through the pump.

Referring now to FIGS. 2, 3–5 and 7, FIGS. 2 and 3–5 show the underside of the lower casing 12 of the pump on which base **12*e* is formed with an upstanding annular wall 64. Centrally within the annular wall the base has a blind annular bore 66 occupied by an upstanding cylindrical platform 68. Platform 68 is formed with a through bore 70 which passes through transverse rib 21*a* and communicates internally of chamber 16. The upper surface of platform 68 is substantially flush with a shoulder 72 set into base around the mouth of the annular bore. An exhaust passageway 74 is formed through the longitudinal rib of the lower shell one end of which opens into the annular bore 66 and the opposite end of which opens into an outlet cavity 76 formed adjacent end wall 12*c* of the base. The outlet cavity may be filled with an air permeable noise insulating material 77 held in place by a suitable porus cover 77*a* to allow air to be exhausted therethrough. A transfer passageway 78 extends through the transverse rib 21*a* of the base and has one open end 79 located within that area of the base defined by the annular wall 64. Within the lower shell sidewall 12*a* is formed with an elongate scolloped portion 80, the lowermost end of which includes the other open end 81 of transfer passageway 78. Transfer passageway 78 communicates with the upper chamber 17 by means of a transfer tube 78*a* which depends downwardly from partition 15 and has its free end sealingly seated against the open end 81 of the transfer passageway within the scolloped portion 80 in sidewall 12*a***.

The annular bore 66 and through bore 70 are both covered by a disc 82 of flexible non-porous material the periphery of which is held on the shoulder 72 by a securing ring 84 and the disc 82 provides a valve to control the flow of air through the bore 70.

A valve disc actuating plate 86 is held over the valve disc 82 by a flexible diaphragm ring 88 whose inner periphery is secured to the plate 86 and whose outer periphery is secured to the annular wall 64. The diaphragm ring and plate assembly thereby covers the base area defined by the annular wall and forms between itself and that base area an enclosed pocket 90. The plate can therefore move towards and away from the valve disc upon flexing of the diaphragm ring. The face of plate 86 within the pocket 90 is provided with a projection 87 in registry with the valve disc and which pushes downwardly on the valve disc when the actuating plate moves towards the base.

When the pump is inactive, the valve disc 82 and the plate assembly 86, 88 are relaxed whereby the annular bore 66 communicates with the through bore 70 and plate 86 is disengaged from the valve disc 82. When the pump is activated, on the initial induction strokes of the diaphragm assemblies 28, 30 air is evacuated from the pocket 90 via the transfer passageway 78 and transfer tube **78*a* because the transfer tube opens into upper chamber 17 and air is being drawn in from the upper chamber by the opposed pump diaphragms. Thus, the valve disc actuating plate 86 is drawn towards the base, such movement being allowed by flexing of the diaphragm ring 88, so that the projection carried by plate 86 pushes against the disc 82 and causes it to seat and seal off the through bore 70. Air which is discharged from the diaphragm assemblies cannot then issue through the through bore 70 and therefore is exhausted from the lower shell only through the discharge nozzle 'N' of the pump. When the pump is deactivated, plate 86 returns to its rest position as the diaphragm ring 86 relaxes so that air may be expelled from an inflated garment back through the discharge nozzle, the through bore 70 and thence the annular bore 66 and is exhausted through the outlet cavity 76 via exhaust passageway 74**.

Figure 11:
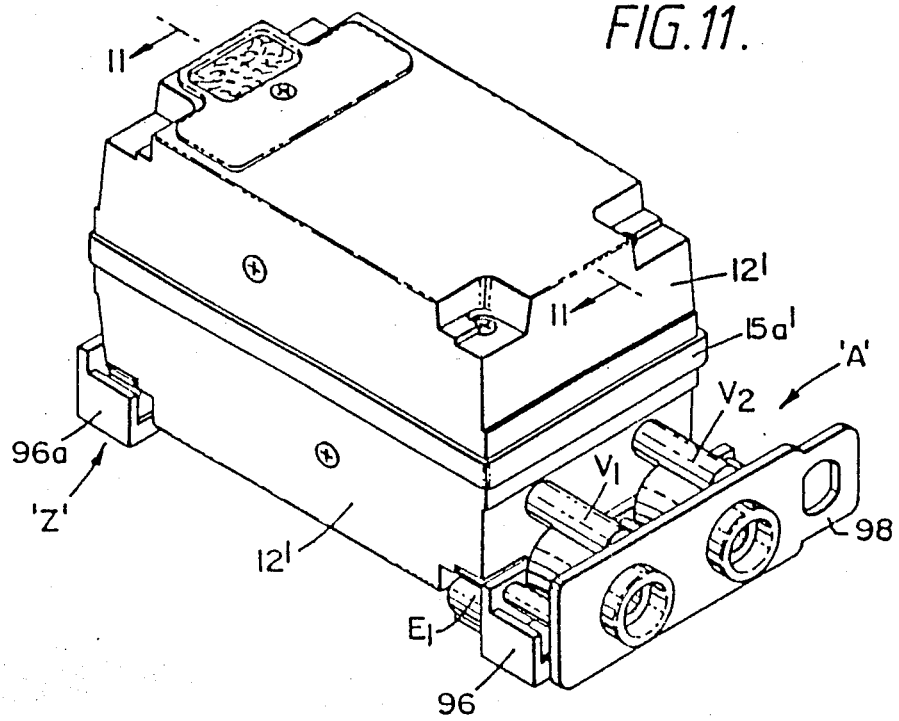
FIG. 11 is a perspective view of a second pump according to the invention in which the operative parts of the pump are housed in both the upper and lower shells.
Figure 12:
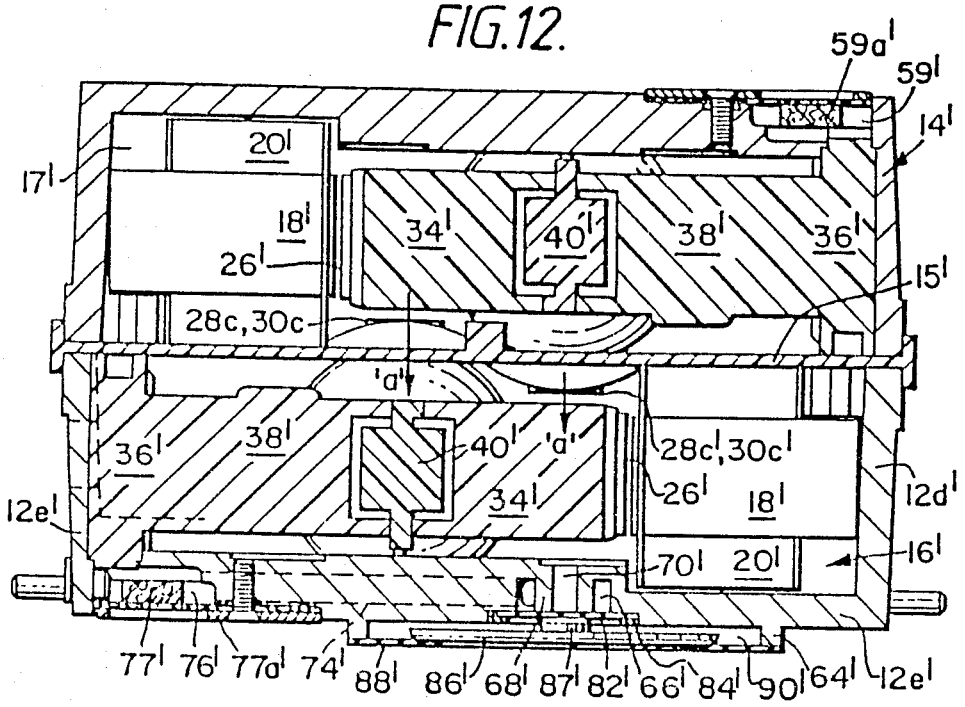
FIG. 12 is a side cross-sectional view taken along the line 11—11 in FIG. 11.
Figure 13:
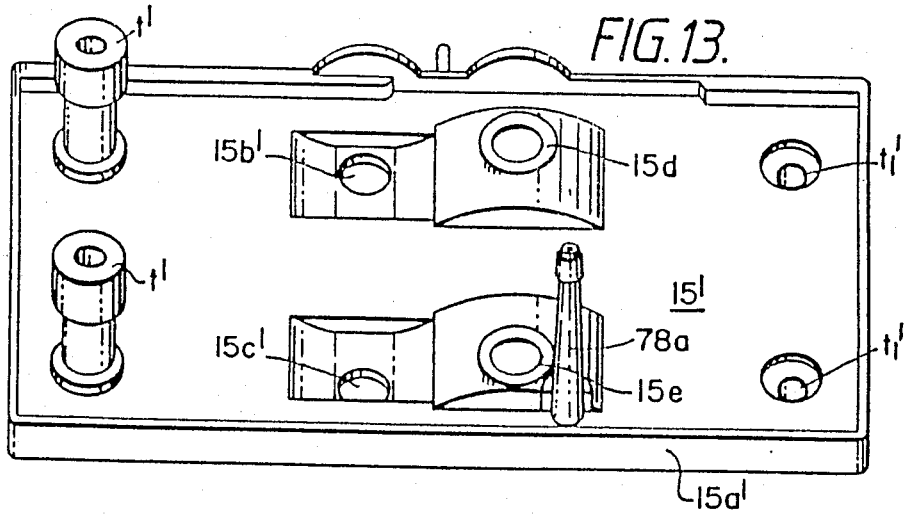
FIG. 13 is a top plan view of a modified partition which separates the two shells of the pump casing shown in FIGS. 11 and 12.

A further pump 'F' embodying the invention is shown in FIGS. 11 and 12. In this construction, the lower shell of the pump is as described above but the lid 14 is substituted by an upper shell which is of similar overall construction to the lower shell. Thus, the upper shell also contains a driving coil and an armature assembly which operates a pair of opposed diaphragm assemblies. The upper shell 14' is fitted to the lower shell in top-to-toe relationship whereby the driving coil 18' in the upper shell is at the opposite end of the casing to that of the lower shell as best seen in FIGS. 11—19 in which like parts are designated with like reference numerals with the addition of suffix "'" e.g. upper shell 14'. In this construction, the flap valves within the valve bodies in the upper shell 14' are reversed in position so that inlet nozzles become outlet nozzles and outlet orifices become inlet orifices.

The partition 15' for this modified pump includes two sets of nozzle apertures **15*b'*, 15*c'*, 15*d* and 15*e*. The inlet nozzles 28*c*, 30*c* of the lower shell diaphragm assemblies protrude into the upper chamber 14' through apertures 15*b'*, 15*c'* and draw air in the direction of arrow 'a'. Conversely the outlet nozzles 28*c'*, 30*c'* of the upper shell diaphragm assemblies protrude into the lower chamber through apertures 15*d* and 15*e*** and pump air in the direction of arrow 'a'. Thus, air is induced from the upper chamber into both the upper and lower diaphragm assemblies and pumped directly into the lower chamber.

In order to connect together the upper and lower shells in the case of the pump shown in FIG. 1 having a shallow (lid) upper shell at one end, screw fasteners pass through suitable apertures 'f1' in the lower shell and thence through sealing tubes 't' integral with partition 15 and locate in connecting nuts in the upper shell. At the opposite end, screw fasteners pass through the suitable apertures in the upper shell and thence through sealing tubes 't1' (which extend from the opposite face of the partition 15 to tubes 't') and locate in connecting nuts 's' which secure the E-stack to the lower shell. In the case of the double pump arrangement where the two shells are similar screw fasteners pass through apertures at one end of the lower shell, thence through sealing tubes in partition 15' and locate in connecting nuts which secure the Estack to the upper shell. A similar arrangement exists at the opposite end of the pump but in which the screw fasteners pass down from the upper shell and through oppositely directed sealing tubes in partition 15'.

The assembled pump is supported on a base by mounting asembly 'A' at the right-hand end of the pump casing and mounting assembly 'Z' at the left-hand end of the casing. Assembly 'A' comprises mounting cradle 96; front plate 98; pump outlet valves V1 and V2, and resilient elements E1, E2. Assembly 'Z' comprises a mounting cradle 96a similar to cradle 96 but fixed to the pump casing in a reversed position i.e. in which it is turned through 180° relative to cradle 96.

Figure 14:
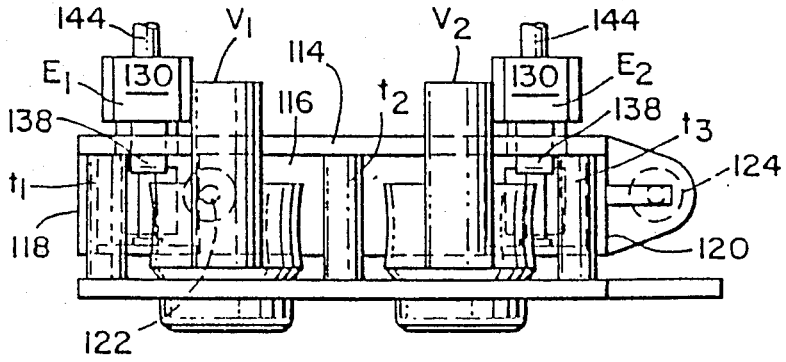
FIG. 14 is a plan view of the shock absorbing mounting assembly shown at the right hand end of the pump casing shown in FIG. 11.

The cradle 96 comprises an elongate 'L'-shaped bracket comprising upright face 114, base 116 and end walls 118, 120 respectively. Outrigger feet 122 and 124 extend from respective ones of the end walls by which the mounting assembly is secured to a base. Assembly 'A' is secured to the pump casing by a pair of similar resilient elements $E_1$, $E_2$ as shown in FIG. 14 and with the upright face 114 of cradle 96 engaged against the adjacent end face of the pump casing.

Referring particularly to FIG. 17, a resilient element 'E' is formed from an elastomeric material e.g. rubber and comprises a hollow, generally cylindrical body portion, 126 having a central bore 128. The body portion is outwardly flared at diametrically opposed locations to form upper and lower flat support platforms 130, 132 which are co-extensive with the cylindrical body. A first bore 134 is formed through the cylindrical body adjacent upper platform 130 and a similar bore 136, but of smaller diameter, is provided adjacent the lower platform 132. Both bores 134 and 136 have axes parallel to that of central bore 128. At one axial end of the body portion, the upper bore 134 is co-axial with an integral extension tube 138.

In assembly 'A' the resilient elements '$E_1$' and '$E_2$' are secured at spaced locations adjacent the ends of cradle 96 each by a fixing pin 'p' which passes through lower bore 136 and through aperture 140 formed in upright face 114. Tube 138 is received in aperture 142 in the upright face, the aperture 142 being significantly larger than the diameter of the tube. A connecting pin 144 extends through tube 138, upper bore 134 and into a portion of the end wall of the pump casing thereby connecting the cradle to the pump. When correctly positioned the upper platform 130 of each element '$E_1$', '$E_2$' engages a base portion of the pump casing (in this construction provided by a rebated corner) and the lower platform seats on a support base. In assembly 'A', front plate 98 carries a pair of pump outlet valves $V_1$, $V_2$ and is connected to the upright face 114 of cradle 96 by means of screw-threaded fasteners which pass through spacer tubes '$t_1$'–'$t_3$'. The assembly is secured to base 'B' by suitable fasteners which interconnect support studs with the outrigger feet.

Referring to FIGS. 17, 18 and 19, assembly 'Z' comprises a cradle 96a and a pair of the resilient elements $E_1$, $E_2$. However, in this assembly the resilient elements are mounted within the cradle. To this end, the base 116a of the cradle is formed with a retaining frame 145, 147 adjacent each end wall of the cradle, each to receive one of the resilient elements $E_1$ and $E_2$. Within each retaining frame the base is formed with an aperture into which the lower support 132 of the associated resilient element is located. The resilient element is mounted in the cradle so that the upper support platform stands above the cradle end walls ready to receive a base portion of the pump casing. As in assembly 'A', the tube 138 extends through oversized aperture 142a in upright face 114 and a connecting pin 144a passes through the tube into the pump casing as described earlier. In order to secure each resilient element within its retaining frame a fixing pin " extends through the lower bore 136 of the resilient element and is received in an aperture, provided in upright face 114a and in an aperture formed in an opposed wall 'w' of the retaining frame. As in the other assembly the pump casing is supported on the upper platforms of the resilient elements, but in assembly 'Z' the cradle is offered up to the pump end wall with the upright face of the cradle facing in the opposite direction relative to the pump casing as compared with assembly 'A'.

The resilient elements 'E' in each of the mounting assemblies 'A' and 'Z' allow vibratory motion of the casing and other limited movement caused e.g. by shock forces to be substantially absorbed so that vibratory motion, in particular, is not transmitted to a base which may form a part of an outer enclosure in which the pump casing is housed. Moreover, the arrangement by which the extension tube 138 is received in the oversized aperture 142 or 142a in the upright face 114, 114a of the mounting cradle 96, 96 a respectively permits limited universal movement of the pump casing relative to each mounting assembly. However, such movement is restricted by the rigid connecting pin 144 or 144a which engages the periphery of the aperture 142, 142a respectively thereby to limit movement of the pump casing so that undue pitching and/or yawing of the casing is minimised. Rolling vertical and horizontal movement of the pump casing relative to the mounting assemblies is limited by the resilient nature of the resilient elements 'E'.

I claim:

1. A pneumatic vibratory diaphragm pump, characterised by a casing comprising an upper chamber having an inlet by which air can be drawn from outside the casing and a lower chamber having an outlet from which air can issue from the casing, an oscillatory armature within the lower chamber to actuate a diaphragm of at least one diaphragm and valve assembly and drive means to cause oscillatory movement of the armature, each diaphragm and valve assembly being operatively connected with the upper chamber so as to induce air to be pumped thereby from the upper chamber and to discharge air into the lower chamber whereby the lower chamber provides an expansion chamber for the pump and from which the discharged air issues from said outlet.

2. A pump according to claim 1, further characterised in that the upper and lower chambers are separated by a partition which isolates said chambers from one another during operation of the pump and wherein an inlet for each diaphragm and valve assembly accommodated in the lower chamber communicates with said upper chamber through said partition.

3. A pump according to claim 1, further characterised in that the lower chamber is provided by a lower shell of the casing and the upper chamber is provided by an upper shell of the casing, said upper and lower shells being secured together in superposed fluid-tight relationship.

4. A pump according to any of claims 1 further characterised in that the upper chamber also accommodates an oscillatory armature to actuate a diaphragm of at least one further diaphragm and valve assembly and drive means to cause oscillatory movement of the armature in the upper chamber, each diaphragm and valve assembly within said casing being arranged so as to induce air to be pumped thereby from the upper chamber and to discharge air into the lower chamber from whence the discharged air issues from said outlet.

5. A pump according to claim 4, further characterised in that the armature in the upper chamber extends in the opposite direction to that of the armature in the lower chamber and the respective drive means for each armature is disposed at opposed ends of the casing in the respective chambers.

6. A pump according to claim 1 further characterised by venting means to allow air which has been discharged from the casing into a container to return therefrom and exhaust from the casing when the pump is inactive said venting means being arranged to close said exhaust when the pump is operative.

7. A pump according to claim 6 further characterised in that operation of the venting means to open and close the exhaust is automatic upon respectively deactivating and activating the pump, said venting means comprising a valve controlled output from the casing independent of said outlet means.

8. A pump according to claim 1 characterised in that said drive means is coupled to control means for causing intermittent operation of the pump.

9. An armature for a vibratory diaphragm pump which armature comprises a main body portion carrying at one end thereof a pair of opposite polarity magnets said main body portion having an opening therein in which a pivotal element is rotatably mounted, said pivotal element being adapted for pivotal connection to a pair of diaphragm assemblies disposed in alignment adjacent opposed sides of the main body portion and a resilient strip interconnecting the main body portion with an end part of the armature by which end part the armature can be mounted, said resilient strip permitting flexing of said main body part relative to said end part for producing vibratory movement of the armature.

10. An armature according to claim 9 further characterised in that said resilient element comprises a spring steel plate.

* * * * *